US007111694B2

(12) United States Patent
Beaton

(10) Patent No.: US 7,111,694 B2
(45) **Date of Patent: *Sep. 26, 2006**

(54) FIXED BLADE FIXED CUTTER HOLE OPENER

(75) Inventor: Timothy P. Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/846,111

(22) Filed: May 14, 2004

(65) Prior Publication Data

US 2004/0222025 A1 Nov. 11, 2004

Related U.S. Application Data

(63) Continuation of application No. 10/156,727, filed on May 28, 2002, now Pat. No. 6,742,607.

(51) Int. Cl.
*E21B 7/28* (2006.01)

(52) U.S. Cl. ..... 175/53; 175/406

(58) Field of Classification Search ..... 175/75, 175/385, 390, 398

See application file for complete search history.

(56) References Cited

U.S. PATENT DOCUMENTS 2,028,910 A 1/1936 MacClatchie
3,568,784 A * 3/1971 Kammerer, Jr. ..... 175/268
4,385,669 A 5/1983 Knutsen
4,630,694 A 12/1986 Walton et al.
5,385,205 A * 1/1995 Hailey ..... 166/55.8
6,412,579 B1 * 7/2002 Fielder ..... 175/385
6,715,567 B1 * 4/2004 Delgado et al. ..... 175/61
6,729,420 B1 * 5/2004 Mensa-Wilmot ..... 175/385

OTHER PUBLICATIONS

United Kingdom Examination Report dated Jul. 5, 2004 (1 page).
Combined Search and Examination Report dated Jun. 22, 2005 for Application No. GB0504691.7 (7 pages).

* cited by examiner

*Primary Examiner*—Frank Tsay
(74) *Attorney, Agent, or Firm*—Osha Liang LLP

(57) ABSTRACT

A hole opener including a tool body having upper and lower ends. The upper and lower ends may be coupled to adjacent drilling tools. At least two blades are formed on the tool body and are arranged so that the hole opener is positioned concentric with a wellbore, and cutting elements are located on the blades. The at least two blades and the cutting elements are arranged to increase a diameter of a previously drilled wellbore.

A hole opener including a tool body having upper and lower ends. The upper and lower ends may be coupled to adjacent drilling tools. At least two blades are formed on the tool body and are arranged so that the hole opener is positioned concentric with a wellbore, and cutting elements are located on the blades. The hole opener includes a pilot hole conditioning section. The pilot hole conditioning section includes at least two pilot blades formed on the tool body in a position axially ahead of the blades. The pilot blades include a taper at a downhole end and gage pads positioned at selected diameters. At least one cutting element is disposed on the pilot blades.

32 Claims, 6 Drawing Sheets

FIXED BLADE FIXED CUTTER HOLE OPENER

CROSS-REFERENCE TO RELATED APPLICATIONS

This application is a continuation of U.S. patent application Ser. No. 10/156,727, filed on May 28, 2002, now U.S. Pat. No. 6,742,607 and claims the benefit, pursuant to 35 U.S.C. §120, of that application. That application is incorporated by reference in its entirety.

BACKGROUND OF INVENTION

1. Field of the Invention

The invention relates generally to downhole tools used to enlarge wellbores drilled in earth formations. More specifically, the invention relates to a fixed blade fixed cutter hole opener having an advanced cutting structure and gage configuration.

2. Background Art

Polycrystalline diamond compact (PDC) cutters have been used in industrial applications including wellbore drilling and metal machining for many years. In these applications, a compact of polycrystalline diamond (or other superhard material such as cubic boron nitride) is bonded to a substrate material, which is typically a sintered metal-carbide, to form a cutting structure. A compact is a polycrystalline mass of diamonds (typically synthetic) that are bonded together to form an integral, tough, high-strength mass.

An example of a use of PDC cutters is in a drill bit for earth formation drilling is disclosed in U.S. Pat. No. 5,186,268. FIG. 1 in the '268 patent shows a cross-section of a rotary drill bit having a bit body 10. A lower face of the bit body 10 is formed to include a plurality of blades (blade 22 is shown in FIG. 1) that extend generally outwardly away from a rotational axis 15 of the drill bit. A plurality of PDC cutters 26 are disposed side by side along the length of each blade. The number of PDC cutters 26 carried by each blade may vary. The PDC cutters 26 are brazed to a stud-like carrier, which may also be formed from tungsten carbide, and is received and secured within a corresponding socket in the respective blade.

When drilling a wellbore, a PDC bit is attached to the end of a bottom hole assembly (BHA) and is rotated to cut the formations. The PDC bit thus drills a wellbore or borehole having a diameter generally equal to the PDC bit's effective diameter. During drilling operations, it may be desirable to increase the diameter of the drilled wellbore to a selected larger diameter. Further, increasing the diameter of the wellbore may be necessary if, for example, the formation being drilled is unstable such that the wellbore diameter changes after being drilled by the drill bit. Accordingly, tools known in the art such as "hole openers" and "underreamers" have been used to enlarge diameters of drilled wellbores.

In some drilling environments, it may be advantageous, from an ease of drilling standpoint, to drill a smaller diameter borehole (e.g., an 8½ inch diameter hole) before opening or underreaming the borehole to a larger diameter (e.g., to a 17½ inch diameter hole). Other circumstances in which first drilling smaller hole and then underreaming or opening the hole include directionally drilled boreholes. It is difficult to directionally drill a wellbore with a large diameter bit because, for example, larger diameter bits have an increased tendency to "torque-up" (or stick) in the wellbore. When a larger diameter bit "torques-up", the bit tends to drill a tortuous trajectory because it periodically sticks and then frees up and unloads torque. Therefore it is often advantageous to directionally drill a smaller diameter hole before running a hole opener in the wellbore to increase the wellbore to a desired larger diameter.

A typical prior art hole opener is disclosed in U.S. Pat. No. 4,630,694 issued to Walton et al. The hole opener disclosed in the '694 patent includes a bull nose, a pilot section, and an elongated body adapted to be connected to a drillstring used to drill a wellbore. The hole opener also includes a triangularly arranged, hardfaced blade structure adapted to increase a diameter of the wellbore.

Another prior art hole opener is disclosed in U.S. Pat. No. 5,035,293 issued to Rives. The hole opener disclosed in the '293 patent may be used either as a sub in a drill string, or may be coupled to the bottom end of a drill string in a manner similar to a drill bit. This particular hole opener includes radially spaced blades with cutting elements and shock absorbers disposed thereon.

Other prior art hole openers include, for example, rotatable cutters affixed to a tool body in a cantilever fashion. Such a hole opener is shown, for example, in U.S. Pat. No. 5,992,542 issued to Rives. The hole opener disclosed in the '542 patent includes hardfaced cutter shells that are similar to roller cones used with roller cone drill bits.

There is a need, however, for a hole opener that makes use of recent advances in PDC cutter and blade technology. While PDC cutters have been used with, for example, prior art near-bit reamers, the PDC cutters on such reamers are generally arranged in a relatively simplistic fashion. This arrangement, among other factors, forms a relatively unreliable mechanical structure that is not durable, especially when drilling tough formations. Moreover, some prior art hole openers generate high levels of vibration and noise, and tend to cause the well trajectory deviate from the existing well trajectory. Therefore, it would be advantageous to produce hole openers with improved cutting structures.

SUMMARY OF THE INVENTION

In one aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades, and the at least two blades and the plurality of cutting elements are adapted to increase a diameter of a previously drilled wellbore.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. The plurality of cutting elements are arranged so that a net lateral force acting on the at least two blades is less than approximately 15% of an axial force applied to the hole opener.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. The plurality of cutting elements are arranged so as to substantially balance work performed by each of the at least two blades.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades, and the at least two blades and the plurality of cutting elements are adapted to increase a diameter of a previously drilled wellbore. The at least two blades are adapted to substantially mass balance the hole opener about an axis of rotation thereof.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. The plurality of cutting elements are positioned to each have a backrake angle different than about 20 degrees.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. The plurality of cutting elements comprises at least one cutting element having a diameter of at least one of 9.0 mm, 11.0 mm, 16.0 mm, 22.0 mm, and 25.0 mm.

In another aspect, the invention is a hole opener including a tool body comprising upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. Surfaces of the at least two blades are shaped so that a cutting element exposure is equal to at least a half of a diameter of the cutting element.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. At least one of the cutting elements on one of the blades is positioned so as to form a redundant cutting arrangement with at least one other one of the cutting elements disposed on a different one of the blades.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. The at least two blades and the tool body are formed from a non-magnetic material.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of the previously drilled wellbore. The at least two blades are formed from a matrix material infiltrated with a binder alloy.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. A perpendicular distance measured from a surface of the tool body to an outermost extent of a gage cutting element disposed on the at least two blades is equal to at least three times a diameter of the gage cutting element.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. The at least two blades comprise a diamond impregnated material. The at least two blades are adapted to increase a diameter of a previously drilled wellbore.

In another aspect, the invention is a hole opener including a tool body having upper and lower ends adapted to be coupled to adjacent drilling tools. At least two blades are formed on the tool body and are arranged so that the hole opener is positioned substantially concentric with a wellbore when disposed therein. A plurality of cutting elements are disposed on the at least two blades. The at least two blades and the plurality of cutting elements are adapted to increase a diameter of a previously drilled wellbore. A pilot hole conditioning section comprising at least two azimuthally spaced apart pilot blades is formed on the tool body axially ahead of the at least two blades. The pilot blades are tapered toward a downhole end thereof. Gage pads positioned at selected diameters, and at least one cutting element is disposed on each pilot blade.

Other aspects and advantages of the invention will be apparent from the following description and the appended claims.

DETAILED DESCRIPTION

Figure 1:
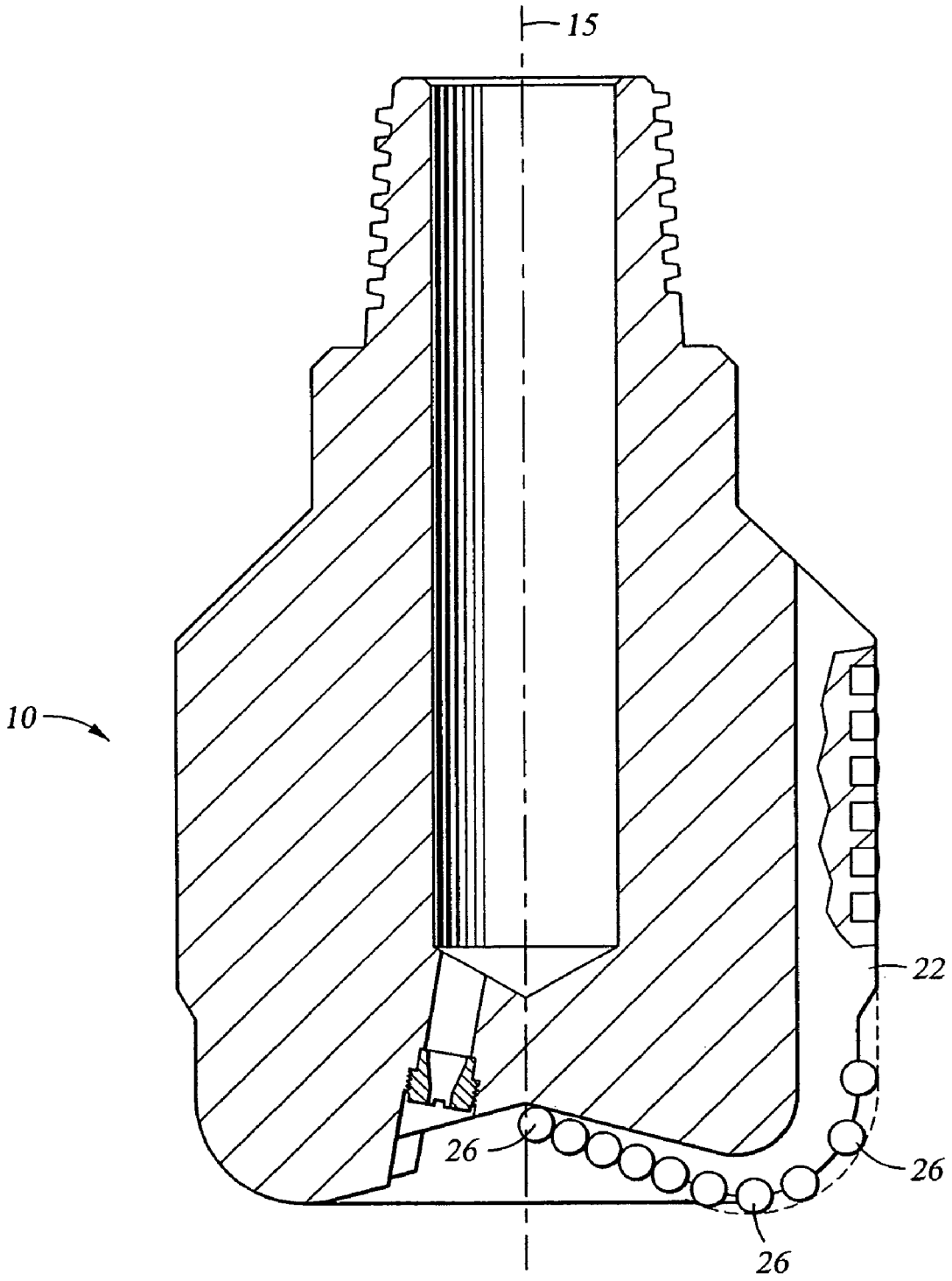
Fig. 1 (PRIOR ART)
FIG. 1 shows a cross-sectional view of a prior art PDC drill bit.
Figure 2:
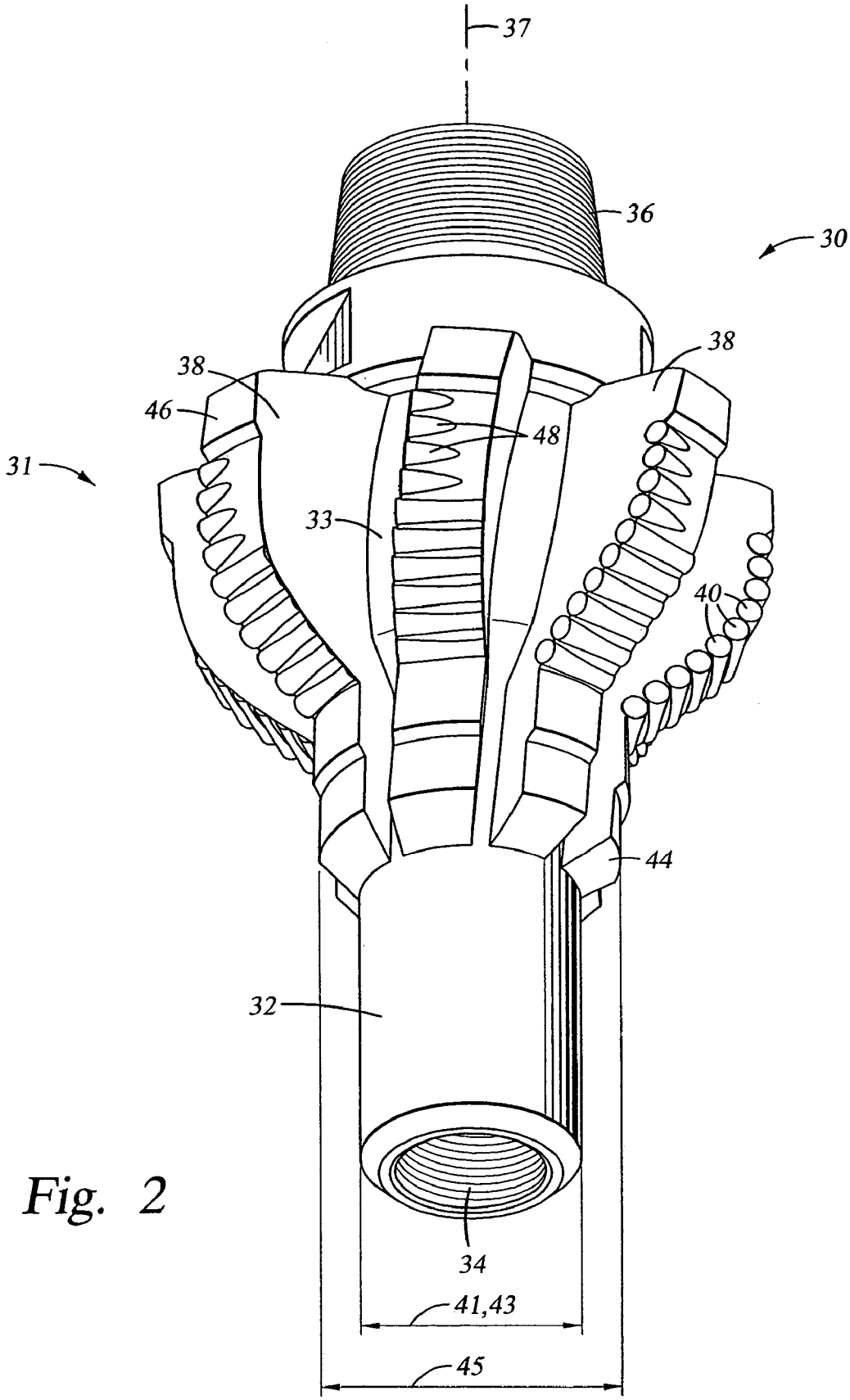
FIG. 2 shows a perspective view of an embodiment of the invention.

FIG. 2 shows a general configuration of a hole opener 30 that includes one or more aspects of the present invention. The hole opener 30 includes a tool body 32 and a plurality of blades 38 disposed at selected azimuthal locations about a circumference thereof. The hole opener 30 generally comprises connections 34, 36 (e.g., threaded connections) so that the hole opener 30 may be coupled to adjacent drilling tools that comprise, for example, a drillstring and/or bottom hole assembly (BHA) (not shown). The tool body 32 generally includes a bore (35 in FIG. 4) therethrough so that drilling fluid may flow through the hole opener 30 as it is pumped from the surface (e.g., from surface mud pumps (not shown)) to a bottom of the wellbore (not shown). The tool body 32 may be formed from steel or from other materials known in the art. For example, the tool body 32 may also be formed from a matrix material infiltrated with a binder alloy.

The blades 38 shown in FIG. 2 are spiral blades and are generally positioned asymmetrically at substantially equal angular intervals about the perimeter of the tool body 32 (refer to, for example, FIG. 4) so that the hole opener 30 will be positioned substantially concentric with the wellbore (not shown) during drilling operations (e.g., a longitudinal axis 37 of the well opener 30 will remain substantially coaxial with a longitudinal axis of the wellbore (not shown)). Other blade arrangements may be used with the invention, and the embodiment shown in FIG. 2 is not intended to limit the scope of the invention. For example, the blades 38 may be positioned symmetrically about the perimeter of the tool body 32 at substantially equal angular intervals so long as the hole opener 30 remains positioned substantially concentric with the wellbore (not shown) during drilling operations. Moreover, the blades 38 may be straight instead of spiral.

The blades 38 each typically include a plurality of cutting elements 40 disposed thereon, and the blades 38 and the cutting elements 40 generally form a cutting structure 31 of the hole opener 30. The cutting elements 40 may be, for example, polycrystalline diamond compact (PDC) inserts, tungsten carbide inserts, boron nitride inserts, and other similar inserts known in the art. The cutting elements 40 are generally arranged in a selected manner on the blades 38 so as to drill a wellbore having a larger diameter than, for example, a diameter of a wellbore (not shown) previously drilled with a drill bit. For example, FIG. 2 shows the cutting elements 40 arranged in a manner so that a diameter subtended by the cutting elements 40 gradually increases with respect to an axial position of the cutting elements 40 along the blades 38 (e.g., with respect to an axial position along the hole opener 30). Note that the subtended diameter may be selected to increase at any rate along a length of the blades 38 so as to drill a desired increased diameter (D1 in FIG. 4) wellbore (not shown).

In other embodiments, the blades 38 may be formed from a diamond impregnated material. In such embodiments, the diamond impregnated material of the blades 38 effectively forms the cutting structure 31. Moreover, such embodiments may also have gage protection elements as described below. Accordingly, embodiments comprising cutting elements are not intended to limit the scope of the invention.

The hole opener 30 also generally includes tapered surfaces 44 formed proximate a lower end of the blades 38. The tapered surfaces 44 comprise a lower diameter 43 that may be, for example, substantially equal to a diameter 41 of the tool body 32. However, in other embodiments, the lower diameter 43 may be larger than the diameter 41 of the tool body 32. The tapered surfaces 44 also comprise an upper diameter 45 that may, in some embodiments, be substantially equal to a diameter of the wellbore (not shown) drilled by a drill bit (not shown) positioned below the hole opener 30 in the drillstring (not shown). In other embodiments, the upper diameter 45 may be selected so as to be less than the diameter of the wellbore (not shown) drilled by the drill bit (not shown). Note that the tapered surfaces are not intended to be limiting.

In some embodiments, the tapered surfaces 44 may also include at least one cutting element disposed thereon. As described above, the cutting elements may comprise polycrystalline diamond compact (PDC) inserts, tungsten carbide inserts, boron nitride inserts, and other similar inserts known in the art. The cutting elements may be selectively positioned on the tapered surfaces 45 so as to drill out an existing pilot hole (not shown) if, for example, an existing pilot hole (not shown) is undersize.

Figure 3:
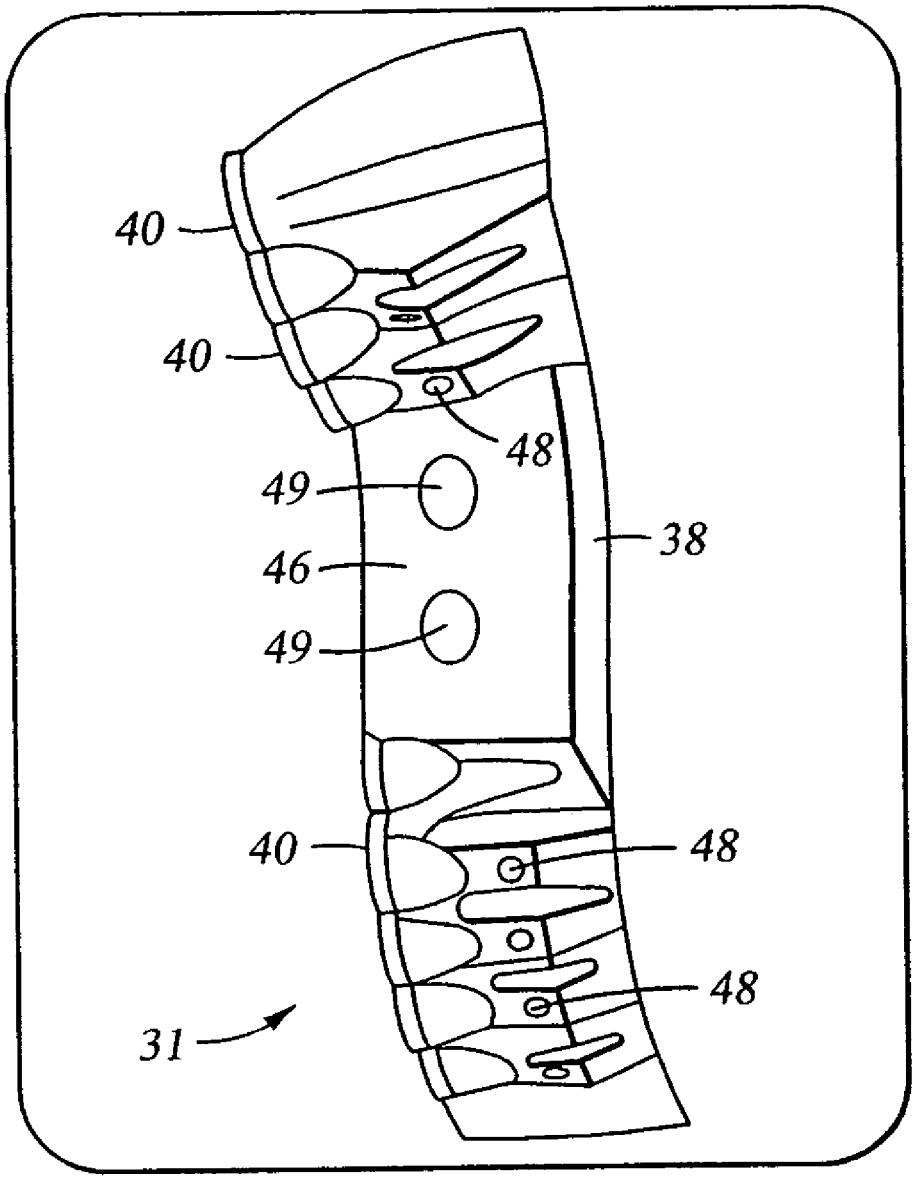
FIG. 3 shows a side view of a blade structure according to an embodiment of the invention.

The hole opener 30 also comprises gage surfaces 46 located proximate an upper end of the blades 38. The gage surfaces 46 shown in the embodiment of FIG. 2 are generally spiral gage surfaces formed on an upper portion of the spiral blades 38. However, other embodiments may comprise substantially straight gage surfaces. In one aspect of the invention shown in the embodiment of FIG. 3, the gage surfaces (46 in FIG. 3) may include gage protection elements (49 in FIG. 3) disposed thereon. The gage protection elements (49 in FIG. 3) may comprise, for example, PDC inserts, thermally stabilized polycrystalline (TSP) inserts, diamond inserts, boron nitride inserts, tungsten carbide inserts, diamond impregnated inserts, and the like.

In other embodiments, the cutting elements (40 in FIG. 2) may comprise different diameter cutting elements. For example, 13 mm cutting elements are commonly used with PDC drill bits. The cutting elements disposed on the blades (38 in FIG. 2) may comprise, for example, 9 mm, 11 mm, 16 mm, 19 mm, 22 mm, and/or 25 mm cutters, among other diameters. Further, different diameter cutting elements may be used on a single blade (e.g., the diameter of cutting elements maybe selectively varied along a length of a blade).

In another aspect of the invention, the cutting elements (40 in FIG. 2) may be positioned at selected backrake angles. A common backrake angle used in, for example, prior art PDC drill bits is approximately 20 degrees. However, the cutting elements in various embodiments according to this aspect of the invention may be positioned at backrake angles of greater than or less than 20 degrees. Moreover, the backrake angle of the cutting elements may be varied. In one embodiment, the backrake angle is variable along the length of the blade. In a particular embodiment, the backrake angle of each cutting element is related to the axial position of the particular cutting element along the length of the blade.

In some embodiments, the blades (38 in FIG. 2) and/or other portions of the cutting structure (31 in FIG. 2) may be formed from a non-magnetic material such as monel. In other embodiments, the blades (38 in FIG. 2) and/or other portions of the cutting structure (31 in FIG. 2) may be formed from materials that include a matrix infiltrated with binder materials. Examples of these infiltrated materials may be found in, for example, U.S. Pat. No. 4,630,692 issued to Ecer and U.S. Pat. No. 5,733,664 issued to Kelley et al. Such materials are advantageous because they are highly resistant to erosive and abrasive wear, yet are tough enough to withstand shock and stresses associated with harsh drilling conditions.

Figure 4:
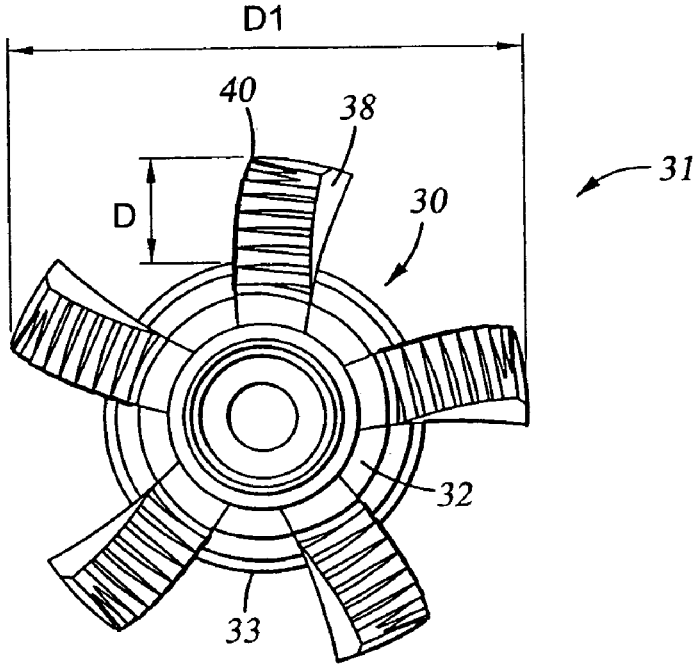
FIG. 4 shows a bottom view of an embodiment of the invention.

Referring to FIG. 4, in another aspect of the invention, a distance D from a surface 33 of the tool body 32 to an outer extent of a cutting element 40 positioned at a selected diameter (D3 in FIG. 7) on a blade 38 of the hole opener 30 may be greater than twice the diameter of the cutting element 40. This distance D, typically referred to as "blade standoff" defines, for example, a clearance between a formation (not shown) and the surface 33 of the tool body 32. A blade standoff D of, for example, at least two cutting element diameters may help improve circulation of drilling fluid around the blades 38 and the cutting elements 40. Note that other embodiments may include, for example, blade standoffs of at least three cutting element diameters. Accordingly, transport of drill cuttings is improved, and improved drilling fluid circulation also improves cutting element cooling. Improved cutting element cooling may help prevent heat checking and other degrading effects of friction produced by contact between the cutting elements 40 and the formation (not shown).

In other embodiments of the invention, a geometric configuration of the blade (38 in FIG. 2) is adapted (e.g., a portion of the blade (38 in FIG. 2) may be shaped) to provide increased cutting element exposure. The exposure of the cutting elements (40 in FIG. 2), which may be defined as a portion of a diameter of the cutting elements (40 in FIG. 2) extending beyond the blade (38 in FIG. 2), in some embodiments is at least half of a diameter of the cutting elements (40 in FIG. 2) (e.g., 7.0 mm for a 14.0 mm diameter cutting element). This aspect of the invention generally applies to cylindrical cutters having a round or an elliptical cross section. Other embodiments that include larger or smaller diameter cutting elements may comprise different exposures. For example, other embodiments of the invention comprise exposures of greater than half of a diameter of a cutting element.

An example of shaped blade surface is shown in FIG. 2 (refer to the shaped surface of the blade 38). Excess, or "dead," material between cutting elements (40 in FIG. 2) has been removed so as to increase cutting element exposure. Maximizing cutting element exposure helps improve the longevity of the blades (38 in FIG. 2) and cutting structure (31 in FIG. 2) by ensuring that the cutting elements (40 in FIG. 2), rather than the blade material, contacts and drills the formation (not shown). Maximized exposure of cutting elements may also help prevent blade damage, etc.

Figure 5:
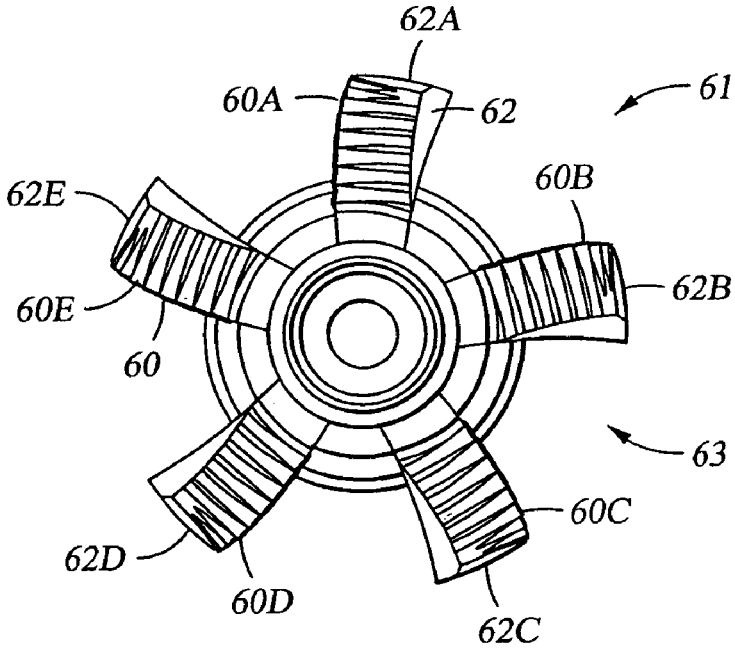
FIG. 5 shows a bottom view of an embodiment of the invention.

In another embodiment shown in FIG. 5, cutting elements 60 are arranged on blades 62 so as to provide a redundant cutting structure for enlarging the wellbore (not shown). For example, the embodiment in FIG. 5 has five blades 62 positioned about a perimeter of a hole opener 61. Cutting element 60B may be referred to as being located in a position "trailing" cutting element 60A (wherein cutting element 60A may be referred to as being in a "leading" position with respect to cutting element 60B). In one aspect of the invention, cutting element 60B may be adapted to drill substantially the same formation as cutting element 60A (e.g., to drill the formation at substantially the same axial position with respect to a longitudinal axis the hole opener). In this type of cutting element arrangement, the cutting elements 60A, 60B are adapted to form a "redundant" cutting structure 63 so as to ensure efficient enlargement of the wellbore (38 in FIG. 2). Further, the cutting elements 60 may be arranged so that corresponding cutting elements 60A, 60B, 60C, 60D, and 60E on different blades 62 are all in a substantially leading/trailing configuration. In another aspect, selected cutting elements disposed on different blades 62 (e.g., cutting elements 60A and 60C and/or cutting elements 60B and 60E) may be adapted to form redundant cutting structures. Other arrangements of cutting element may also be used which are within the scope of this aspect of the invention.

In another aspect of the invention, cutting elements may be positioned in an "opposing" relationship with respect to cutting elements disposed on different blades. This arrangement may be used, for example, when there are an even number of substantially azimuthally equally spaced blades forming a cutting structure on the hole opener. Further, the opposing arrangement may be used when, for example, an asymmetric blade arrangement is used. The opposing arrangement is similar to the leading/trailing redundant arrangement in that opposing cutting elements may be arranged so as to contact the wellbore at substantially the same axial location, thereby providing a redundant cutting structure adapted to ensure efficient drilling of the wellbore.

The embodiment shown in FIG. 5 comprises five blades 62 wherein centerlines of the blades 62 are positioned at approximately 72 degree intervals about the perimeter of the hole opener 61. However, more or fewer blades 62 may be used in other embodiments which are within the scope of this aspect of the invention. For example, other embodiments may have seven blades (see FIG. 2) wherein centerlines of the blades are positioned at approximately 51.4 degree intervals about the perimeter of the hole opener. Moreover, as previously described, in other embodiments the blades may be positioned at unequal angular intervals.

In another aspect of the invention, cutting elements may be positioned on the respective blades so as to balance a force or work distribution and provide a force or work balanced cutting structure. "Force balance" may refer to a substantial balancing of lateral force during drilling between cutting elements on the blades, and force balancing has been described in detail in, for example, T. M. Warren et al., *Drag Bit Performance Modeling*, paper no. 15617, Society of Petroleum Engineers, Richardson, Tex., 1986. Similarly, "work balance" refers to a substantial balancing of work performed between the blades and between cutting elements on the blades.

The term "work" used to describe this aspect of the invention is defined as follows. A cutting element on the blades during drilling operations cuts the earth formation through a combination of axial penetration and lateral scraping. The movement of the cutting element through the formation can thus be separated into a "lateral scraping" component and an "axial crushing" component. The distance that the cutting element moves laterally, that is, in the plane of the bottom of the wellbore, is called the lateral displacement. The distance that the cutting element moves in the axial direction is called the vertical displacement. The force vector acting on the cutting element can also be characterized by a lateral force component acting in the plane of the bottom of the wellbore and a vertical force component acting along the axis of the drill bit. The work done by a cutting element is defined as the product of the force required to move the cutting element and the displacement of the cutting element in the direction of the force.

Thus, the lateral work done by the cutting element is the product of the lateral force and the lateral displacement. Similarly, the vertical (axial) work done is the product of the vertical force and the vertical displacement. The total work done by each cutting element can be calculated by summing the vertical work and the lateral work. Summing the total work done by each cutting element on any one blade will provide the total work done by that blade. In this aspect of the invention, the numbers of, and/or placement or other aspect of the arrangement of the cutting elements on each of the blades can be adjusted to provide the hole opener with a substantially balanced amount of work performed by each blade.

Force balancing and work balancing may also refer to a substantial balancing of forces and work between corresponding cutting elements, between redundant cutting elements, etc. Balancing may also be performed over the entire hole opener (e.g., over the entire cutting structure). In some embodiments, forces may be balanced so that a net lateral force acting on the hole opener (e.g., on the blades) during drilling operations is less than approximately 15% of an axial force or load applied to the hole opener. In other embodiments, the net lateral force acting on the hole opener is less than 10% of the applied axial load, and preferably less than 5%. Balancing to establish a reduced and/or minimized net lateral force helps ensure that the hole opener maintains a desired trajectory without substantial lateral deviation when operating in a wellbore.

In other embodiments, the blades and cutting elements are arranged to substantially mass balance the hole opener about its axis of rotation. For example, substantially identical blades may be arranged symmetrically about the axis of rotation. In other embodiments, asymmetric and/or non-identical blade arrangements may be used to achieve mass balance about the axis of rotation. Mass balancing helps ensure that the hole opener is dynamically stable and maintains a desired drilling and/or hole opening trajectory.

Figure 6:
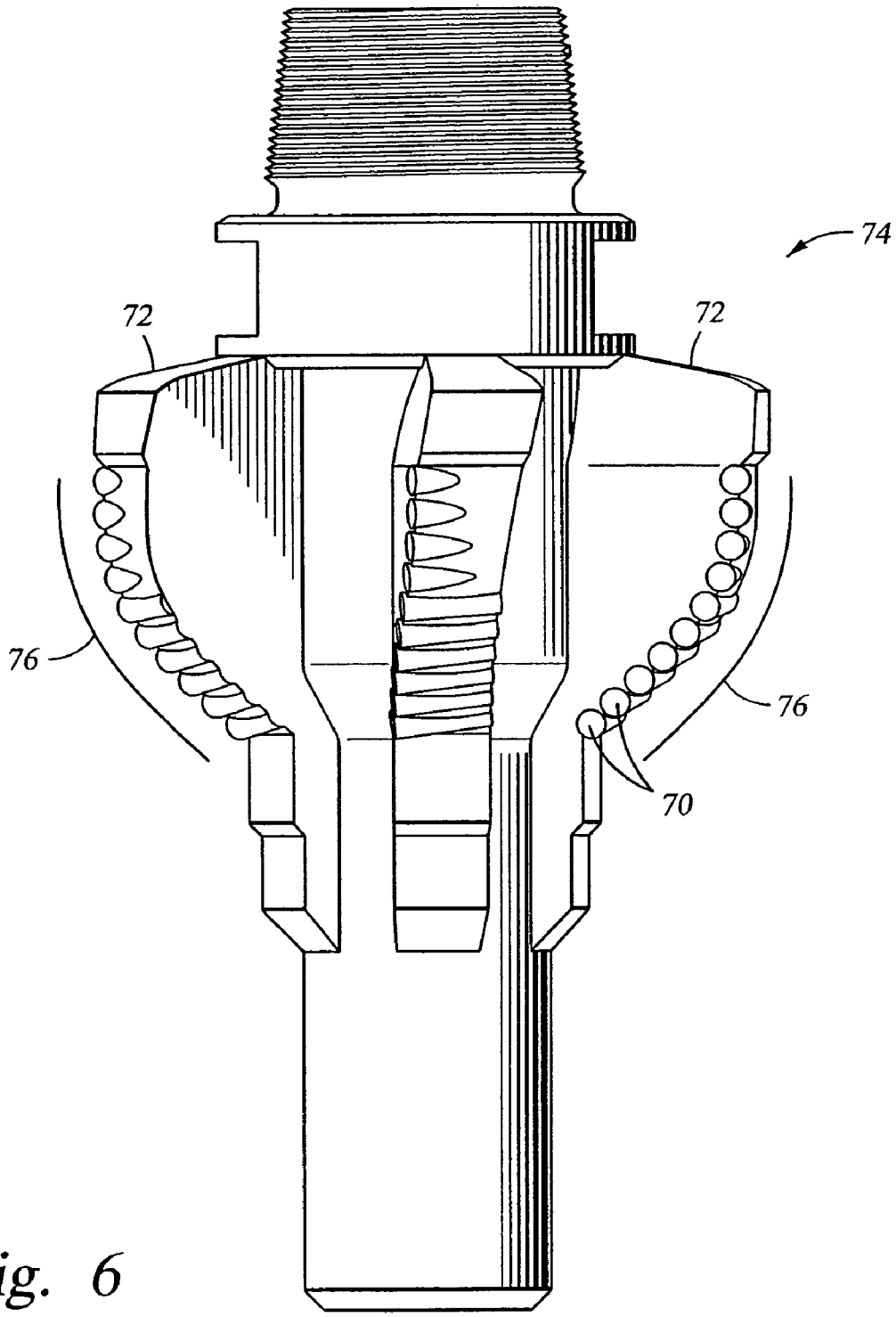
FIG. 6 shows a side view of an embodiment of the invention.

In other embodiments, such as shown in FIG. 6, cutting elements 70 disposed on blades 72 of the hole opener 74 are arranged to form tapered cutting profiles 76. In some embodiments, the cutting profiles 76 may be substantially conical or substantially hemispherical. However, other tapered shapes may be used in other embodiments of the invention. For example, some embodiments comprise tapers wherein diameters of the hole opener 70 subtended by the cutting elements 70 disposed on the blades 72 are dependent upon an axial position of the cutting elements 70 with respect to an axis of the hole opener 74. Arrangement of the cutting elements 70 in tapered cutting profiles 76 enables the hole opener 74 to gradually drill out the formation (not shown) while increasing the diameter of the wellbore (not shown).

Figure 7:
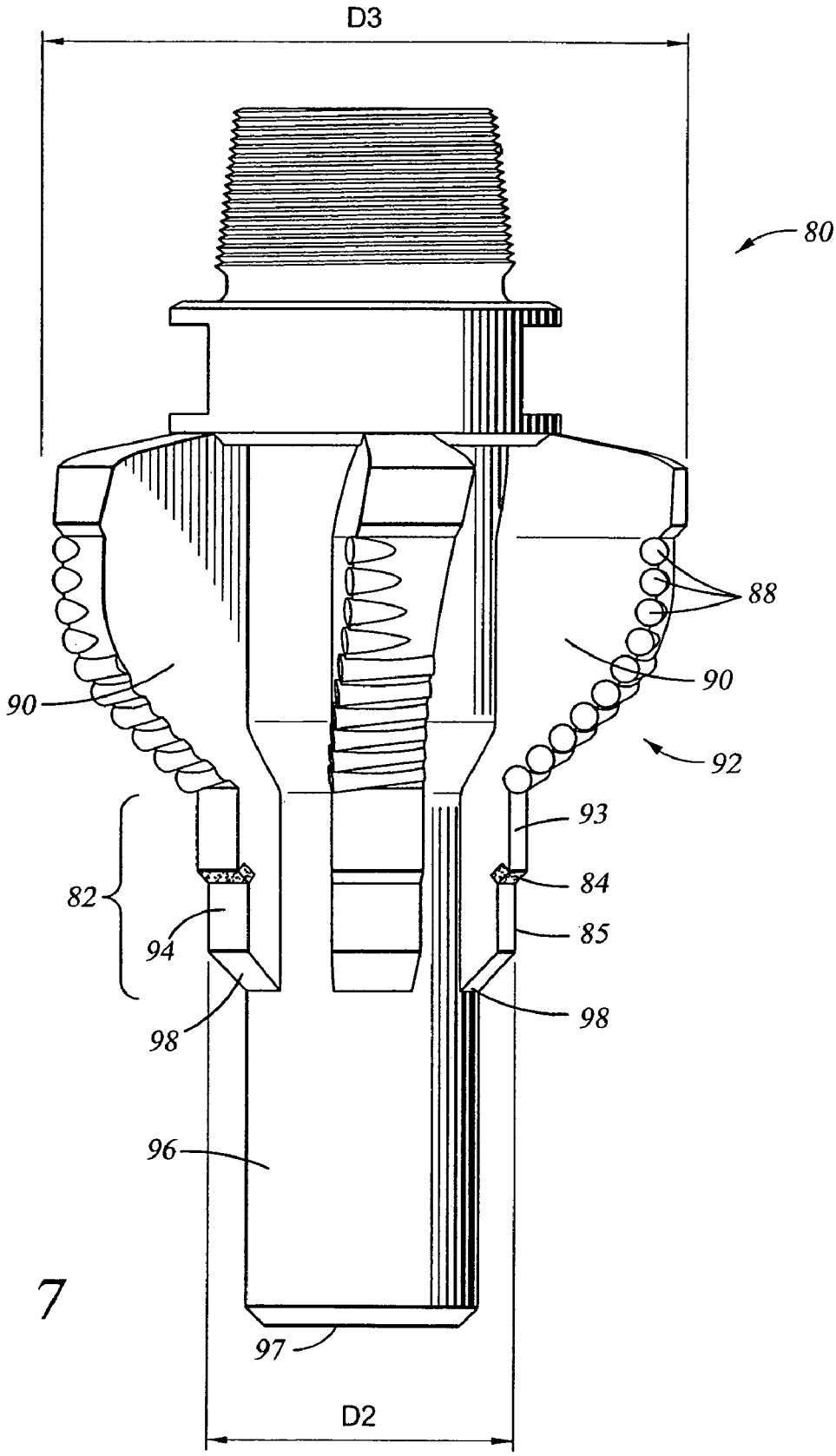
FIG. 7 shows a side view of an embodiment of the invention.

In another embodiment of the invention shown in FIG. 7, a hole opener 80 comprises a pilot hole conditioning section 82 positioned proximate a cutting structure 92 formed on the hole opener 80 (e.g., proximate blades 90). One purpose of the pilot hole conditioning section 82 is to provide a round, smooth borehole which acts as a thrust surface against which cutting elements 88 positioned on the cutting structure 92 of the hole opener 80 can push so that the hole opener 80 can increase the diameter of the wellbore to the full diameter D3. Moreover, the pilot hole conditioning section 82 increases stabilization of the hole opener 80 in the wellbore so as to prevent the hole opener 80 from "walking" or deviating from a desired trajectory.

Further, in some embodiments, blades 85 in the pilot hole conditioning section 82 each include a taper 94 on their "downhole" ends (e.g., the ends nearest threaded connection 97). The blades 85 may comprise, for example, spiral blades or straight blades. The tapers 98 substantially align the hole opener 80 with the existing wellbore (e.g., with a hole drilled by a pilot bit (not shown)).

The numbers of and azimuthal locations of the blades 85 in the pilot hole conditioning section 80 shown in FIG. 7 are not intended to limit the scope of the invention. In some embodiments, the blades 85 are azimuthally positioned around the circumference of the pilot hole conditioning section 82 in a manner that maintains the hole opener 80 in a substantially concentric position with respect to the wellbore (not shown). In some embodiments of the invention, for example, the hole opener 80 comprises two pilot hole conditioning blades 85 spaced 180 degrees apart, or three pilot hole conditioning section blades 85 substantially equally spaced at 120 degree intervals around the circumference of the pilot hole conditioning section 82. However, other blade arrangements, such as an arrangement comprising unequally azimuthally spaced blades, may be used within the scope of the invention.

Pilot gauge pads 94 in the pilot hole conditioning section 82 help to maintain concentric alignment of the hole opener 80 in the wellbore (not shown). As is known in the art, wellbores can be enlarged beyond the diameter of the pilot bit (not shown), can be out of round, or may otherwise not form a smooth cylindrical surface. One aspect of the invention is the positioning of cutting elements 84 in the pilot hole conditioning section 82. The pilot hole conditioning section cutting elements 84 are positioned so as to drill a hole having a slightly larger intermediate diameter D2 than a nominal diameter of the pilot bit (not shown) that, for example, drilled the existing wellbore (not shown). Note that the cutting elements 84 may be arranged with selected backrake angles, in redundant cutting structures, etc., as described above with respect to other embodiments and aspects of the hole opener.

For example, if the pilot bit (not shown) has an 8.5 inch (215.9 mm) diameter, the cutting elements 84 can be laterally positioned along the pilot hole conditioning section blades 85 to drill an intermediate diameter D2 having an approximately 9 inch (228.6 mm) diameter. The intermediate diameter D2 can be maintained by intermediate gauge pads 93 positioned axially "uphole" (e.g., away from the pilot bit) from the cutting elements 84. The cutting elements 84 and the intermediate gauge pads 93 provide a substantially smooth, round, selected diameter thrust surface against which the hole opener 80 can then drill a hole having the selected drill diameter D3. Note that the exemplary diameters for the pilot hole and intermediate pilot hole are provided to clarify the operation of the pilot conditioning section 82 and are not intended to limit this aspect of the invention.

The positions and orientations of the pilot hole conditioning section cutting elements 84 on the pilot blades 85 may be selected to provide a lateral force which substantially matches in magnitude and offsets in azimuthal direction a net lateral force exerted by all the cutting elements 84 on the pilot conditioning section 82 in a manner similar to that described above with respect to cutting elements 88 disposed on the blades 90 of the hole opener 80. Further, the mass balancing, force balancing, work balancing, cutting element arrangement, and other aspects of the invention described above equally apply to the pilot hole conditioning section 82.

Note that, in some embodiments of the invention, a tapered shoulder in the hole opener and in the pilot hole conditioning sections may also comprise gage protection elements (not shown). The gage protection elements (not shown) may help protect the shoulders from wear and may improve the longevity of the hole opener. Moreover, the shoulders may also be coated with hardfacing materials so as to improve the durability of the hole openers.

Advantageously, the cutting structures described above enable a hole opener to efficiently enlarge a wellbore to a selected diameter after the wellbore has been drilled by, for example, a drill bit attached to a bottom hole assembly. Moreover, the cutting structures according to the various aspects of the invention may optimize hole opening parameters (such as rate of penetration) and decrease the time required to enlarge the wellbore to a desired diameter.

Moreover, the cutting structures according to the various aspects of the invention are durable, comprise a very reliable mechanical structure, and are adapted to help reduce vibrations and noise when opening an existing wellbore. The reduction in noise is advantageous when running the hole opener either above, below, or proximate measurement equipment and the like. The hole opener is also dynamically stable and is adapted to more closely follow an existing wellbore without, for example, excessive "walking" or deviation than hole openers known in the art.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A hole opener comprising:

a tool body comprising upper and lower ends adapted to be coupled to adjacent drilling tools;

at least two blades formed on the tool body and arranged so that the hole opener is positioned substantially concentric with a wellbore when disposed therein; and a plurality of cutting elements disposed on the at least two blades, the at least two blades and the plurality of cutting elements adapted to increase a diameter of a previously drilled wellbore, the plurality of cutting elements are arranged to form a tapered cutting structure.

2. The hole opener of claim 1, wherein the at least two blades comprise spiral blades.

3. The hole opener of claim 1, wherein the plurality of cutting elements comprise at least one of polycrystalline diamond inserts, tungsten carbide inserts, and boron nitride inserts.

4. The hole opener of claim 1, further comprising at least one gage protection element disposed on gage surfaces of the at least two blades.

5. The hole opener of claim 4, wherein the at least one gage protection element comprises at least one of a thermally stabilized polycrystalline insert, a polycrystalline diamond insert, and a diamond impregnated insert.

6. The hole opener of claim 1, wherein the plurality of cutting elements are arranged so that a net lateral force acting on the at least two blades is less than approximately 15% of an axial load applied to the hole opener.

7. The hole opener of claim 1, wherein the plurality of cutting elements are arranged so that a net lateral force acting on the at least two blades is less than approximately 5% of an axial load applied to the hole opener.

8. The hole opener of claim 1, wherein the plurality of cutting elements each have a backrake angle of greater than or less than 20 degrees.

9. The hole opener of claim 1, wherein selected ones of the plurality of cutting elements have different backrake angles than other ones of the plurality of cutting elements.

10. The hole opener of claim 1, wherein the plurality of cutting elements comprises at least one cutting element having a diameter of at least one of 9.0 mm, 11.0 mm, 16.0 mm, 22.0 mm, and 25.0 mm.

11. The hole opener of claim 1, wherein at least one of the cutting elements on one of the blades is positioned so as to form a redundant cutting arrangement with at least one other one of the cutting elements disposed on a different one of the blades.

12. The hole opener of claim 1, wherein the at least two blades and the plurality of cutting elements are adapted to substantially mass balance the hole opener about an axis of rotation of the hole opener.

13. The hole opener of claim 1, wherein the at least two blades and the tool body are formed from a non-magnetic material.

14. The hole opener of claim 1, wherein the at least two blades are formed from a matrix material infiltrated with a binder alloy.

15. The hole opener of claim 1, wherein a perpendicular distance measured from a surface of the tool body to an outermost extent of a gage cutting element disposed on the at least two blades is equal to at least three times a diameter of the gage cutting element.

16. The hole opener of claim 1, further comprising a pilot hole conditioning section including:

at least two azimuthally spaced apart pilot blades formed on the tool body axially ahead of the at least two blades, the pilot blades comprising a taper at a downhole end thereof and gage pads positioned at selected diameters; and at least one cutting element disposed on at least one of the pilot blades.

17. The hole opener of claim 1, wherein the tool body is formed from steel.

18. The hole opener of claim 1, wherein the tool body is formed from a matrix material infiltrated with a binder alloy.

19. A hole opener, comprising:

a tool body comprising upper and lower ends adapted to be coupled to adjacent drilling tools;

at least two blades formed on the tool body and arranged so that the hole opener is positioned substantially concentric with a wellbore when disposed therein; and a plurality of cutting elements disposed on the at least two blades, the at least two blades and the plurality of cutting elements adapted to increase a diameter of a previously drilled wellbore, wherein the plurality of cutting elements are arranged so as to substantially balance work performed between the at least two blades.

20. The hole opener of claim 19, wherein the at least two blades comprise spiral blades.

21. The hole opener of claim 19, wherein the plurality of cutting elements comprise at least one of polycrystalline diamond inserts, tungsten carbide inserts, and boron nitride inserts.

22. The hole opener of claim 19, further comprising at least one gage protection element disposed on a gage surface of the at least two blades.

23. The hole opener of claim 19, wherein the at least one gage protection element comprises at least one of a thermally stabilized polycrystalline insert, a polycrystalline diamond insert, and a diamond impregnated insert.

24. The hole opener of claim 19, wherein the plurality of cutting elements each have a backrake angle different than about 20 degrees.

25. The hole opener of claim 19, wherein selected ones of the plurality of cutting elements have different backrake angles than other ones of the plurality of cutting elements.

26. The hole opener of claim 19, wherein the plurality of cutting elements comprises at least one cutting element having a diameter of at least one of 9.0 mm, 11.0 mm, 16.0 mm, 22.0 mm, and 25.0 mm.

27. The hole opener of claim 19, wherein at least one of the cutting elements on one of the blades is positioned so as to form a redundant cutting arrangement with at least one other one of the cutting elements disposed on a different one of the blades.

28. The hole opener of claim 19, wherein the at least two blades and the plurality of cutting elements are adapted to substantially mass balance the hole opener about an axis of rotation of the hole opener.

29. The hole opener of claim 19, wherein surfaces of the at least two blades proximate the plurality of cutting elements are shaped so that a cutting element exposure is equal to at least half of a diameter of the cutting element.

30. The hole opener of claim 19, wherein a perpendicular distance measured from a surface of the tool body to an outermost extent of a gage cutting element disposed on the at least two blades is equal to at least three times a diameter of the gage cutting element.

31. The hole opener of claim 19, further comprising a pilot hole conditioning section including:

at least two azimuthally spaced apart pilot blades formed on the tool body axially ahead of the at least two blades, the pilot blades tapered toward a downhole end thereof and gage pads positioned at selected diameters; and at least one cutting element disposed on at least one of the pilot blades.

32. The hole opener of claim 19, further comprising tapered surfaces formed on the tool body proximate a lower end of the blades, the tapered surfaces comprising at least one cutting element disposed thereon.

* * * * *